US007152840B2

(12) United States Patent
Ottah et al.

(10) Patent No.: US 7,152,840 B2
(45) Date of Patent: Dec. 26, 2006

(54) BOOK HOLDER

(76) Inventors: Chikezie Ottah, 1035 Clarkson Ave., Apt 5a, Brooklyn, NY (US) 11212; Chineye Ottah, 4th Ave #6, TransEklu, GRA, Enugu State (NG); Keneth Ottah, 4th Ave #6, TransEklu, GRA, Enugu State (NG)

( * ) Notice: Subject to any disclaimer, the term of this patent is extended or adjusted under 35 U.S.C. 154(b) by 0 days.

(21) Appl. No.: 10/366,779

(22) Filed: Apr. 24, 2003

(65) Prior Publication Data

US 2004/0214154 A1 Oct. 28, 2004

(51) Int. Cl.
*A47B 5/04* (2006.01)

(52) U.S. Cl. ..... 248/444.1

(58) Field of Classification Search ..... 434/179, 434/308, 309, 317, 322, 365, 428, 430, 432; 248/441.1, 444, 445, 448, 449, 450, 451, 248/454, 458

See application file for complete search history.

(56) References Cited

U.S. PATENT DOCUMENTS 1,377,230 A * 5/1921 Taylor ..... 248/454
2,439,950 A * 4/1948 Rogers ..... 248/447
2,627,694 A * 2/1953 Saecker ..... 248/447
3,351,312 A * 11/1967 Ballas ..... 248/448
3,408,032 A * 10/1968 Francis ..... 248/450
3,497,882 A * 3/1970 Weeks ..... 482/148
4,021,013 A * 5/1977 Wiersma ..... 248/453
4,431,156 A * 2/1984 Mena ..... 248/445
4,553,728 A * 11/1985 Corsello ..... 248/452
4,591,124 A * 5/1986 Hellenbrand et al. .... 248/447.2
4,790,506 A * 12/1988 Malinowski et al. .... 248/441.1
4,867,407 A * 9/1989 Becker ..... 248/444.1
5,054,736 A * 10/1991 Champoux ..... 248/444
5,059,149 A * 10/1991 Stone ..... 446/73
5,460,102 A * 10/1995 Pasmanick ..... 108/43
5,595,489 A * 1/1997 Kwon ..... 434/319
5,615,856 A * 4/1997 Simington ..... 248/452
5,709,365 A * 1/1998 Howard ..... 248/454
5,755,423 A * 5/1998 Michela ..... 248/459
5,855,329 A * 1/1999 Pagano ..... 248/451
5,884,888 A * 3/1999 Grimes et al. ..... 248/441.1
6,045,179 A * 4/2000 Harrison ..... 297/188.2
6,064,855 A * 5/2000 Ho ..... 434/317
6,202,973 B1 * 3/2001 Navarin et al. ..... 248/444

* cited by examiner

*Primary Examiner*—Kurt Fernstrom
(74) *Attorney, Agent, or Firm*—James D. Palmatier; Applied Patent Services

(57) ABSTRACT

A book holder removably attachable to a vehicle or structure such as a stroller, walker, wheelchair or car seat for mobile applications. The book holder for holding a book or drawing surface in a usable position thereon for by the occupant of the vehicle. The book holder comprising an adjustable clasp on the vehicle, an arm extending to a book platform, the arm providing rotational pivotal and axial adjustment to hold the platform in spaced relation to the clasp. A plurality of spring biased clamps on the platform to secure the book to the book holder.

1 Claim, 4 Drawing Sheets

BOOK HOLDER

BACKGROUND OF THE INVENTION

1. Field of the Invention

The present invention relates generally to a removable book holder assembly for use by a person in a protective or mobile structure such as a car seat, wheelchair, walker, or stroller. The Book holder having an adjustable, releasable clipping means and a support arm configured for axial, rotational and pivotal adjustment of the book supporting surface of the book holder to hold a book in a readable position in front of the user.

2. Description of the Related Art

The prior art of book holders comprises a variety of devices for supporting a book on a platform in a position for viewing or reading. A conventional book holder includes a supporting structure for supporting the book support on a table. The platform is supported by a table or other such flat structure as seen in the Michela U.S. Pat. No. 5,755,423 for a FOLDING PORTABLE SUPPORT STAND, wherein a device is disclosed comprising hinged covers folding into a support structure for holding a booking the open position on a flat horizontal surface.

The prior art also discloses structures built around the person to hold a book in useful relation such as the ADJUSTABLE BOOK HOLDER in U.S. Pat. No. 6,202,973 to Navarin et al. In the '973 patent a structure is disclosed for holding a book in a readable position on a structure attachable to the reader's torso. The Weeks U.S. Pat. No. 3,497,882 for SUPPORT MECHANISM FOR SUPPORTING VARIOUS DEVICES TO BE EMPLOYED IN COOPERATION WITH A HOSPITAL BED likewise discloses a support structure disposed over the bed and a book holder slidably mounted on the support structure for holding the book in reading position while the reader is lying in bed.

The Wiersma U.S. Pat. No. 4,201,013 for a BOOK HOLDING DEVICE discloses a detachable device for use on a bed to suspend a book holder from over the reader's head. The Wiersma device is clamped to a headboard of a bed using C-clamps.

The book holders disclosed in the prior art suffer from a number of disadvantages. In particular, such book holders include do not provide an adequate solution for young children or mobility limited adults. These people spend a significant amount of their time outdoors (e.g., parks, beaches, playground, theme parks, etc) and conventional book holders are primarily designed for indoor use. The book holders in the prior art lack the ease of application to a mobile vehicle such as a wheelchair or stroller to allow the reader to have mobility to explore their environment in a stationary sitting or reclining position while reading a book supported on the mobile vehicle. As a result, the learning benefits are significantly reduced.

The prior art does not accommodate easy and quick attaching the book support onto a structure for mobile use. Thus there is a need for an improved Book Holder that is quickly and easily clipped to a mobile vehicle such as a wheelchair or stroller for holding the book in a reading position in spaced relation to the clip.

SUMMARY OF THE INVENTION

It is an object of the present invention to provide a book holder that can be easily and remvoably attached to and removed from a bar or portion of the mobile vehicle without tools.

It is an object of the present invention to provide an adjustable clasp for attaching the book holder to the mobile vehicle to easily and quickly attach or detach the book holder.

It is further object of the present invention to provide an arm between the clasp and the book support platform to hold the book in spaced relation from the clip.

It is another object of the present invention to provide a pivotal attachment between the clasp and the support platform to hold the book on the support platform at a selected angle with respect to the reader for ease of viewing.

It is another object of the present invention to provide a telescoping arm between the clasp and the book support platform to axially adjust the position of the support platform with respect to the clasp to position the platform in a position for ease of viewing by the reader.

It is another object of the present invention to provide a book holder having an elongate arm with a rotational adjustment to rotate the position of the support platform with respect to the clasp to a position for ease of viewing by the reader.

It is another object of the present invention to provide a clasp comprising a clip having an adjustable, resilient arm for removably attaching to a mounting structure on the mobile vehicle.

It is another object of the present invention to provide a locking means on the book holder to retain the rotational, pivotal and axial position of the support platform with respect to the clasp.

It is another object of the present invention to provide a support platform adaptable for use as a writing board.

It is another object of the present invention to provide a connector means for remvoably securing a book to the book holder in a reading position.

DETAILED DESCRIPTION OF THE INVENTION

Figure 1:
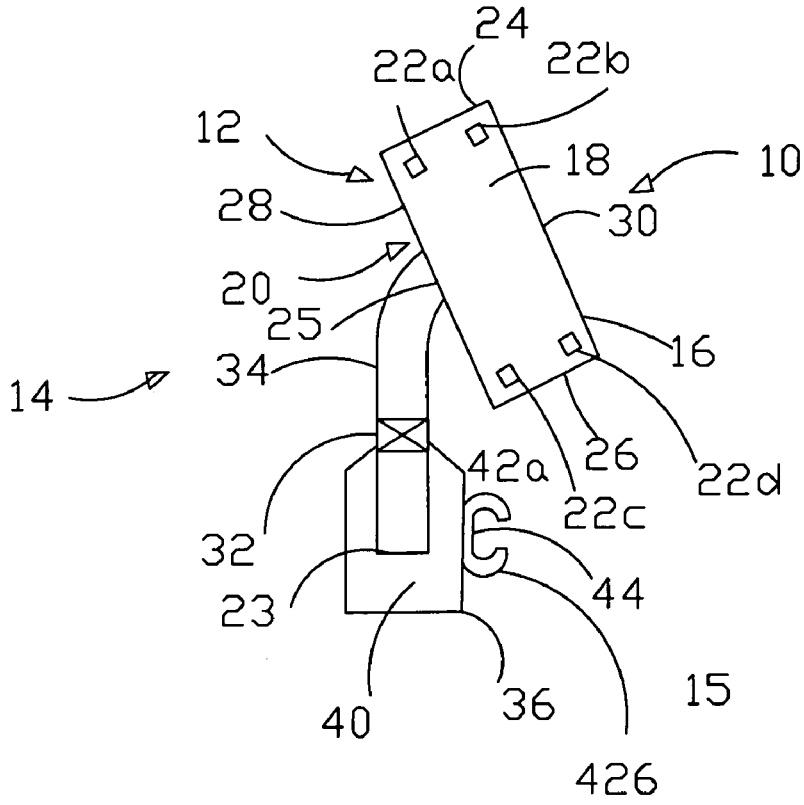
FIG. 1 is a perspective view of a book holder showing a first embodiment of the present invention.

Referring to FIG. 1 there is illustrated a book holder assembly 10 according to the first embodiment of present invention. The book holder 10 comprises a book platform 12 and an adjustable arm 14 and a clasp 15. The book platform 12 includes a generally planar panel 16 having a front 18 and a rear surface 20. The front surface 18 is configured to hold a book or suitable for use as a writing/drawing board (eg a white-board, a blackboard, an electronic board). The rear surface 20 of the book platform 12 is attached to the adjustable support arm 14 at angle suitable for reading. The book platform 12 can be integrally formed with the support arm 14 such that the support arm 14 forms a portion of the book support protrudes from the rear surface 20 of the panel 16. Preferably, though the supporting arm 14 and the book platform 12 are provided as separate items to be assembled by the user.

Mounted to the front surface 18 of panel 16 are two pairs of spring biased book clamps 22 for securing a book (not shown) to the book holder 10. The first pair of spring biased book clamps 22*a*, 22*b* is located near the top edge 24. The second pair of spring biased book clamps 22*c*, 22*d* is located near the bottom edge 26.

Continuing to refer to FIG. 1 the panel 16 may be made of plastic and the book clamps 22 made of steel covered by plastic. However, other materials such as wood, metal, etc, and combination thereof may be used in the manufacturing of the book holder assembly 10.

Figure 2:
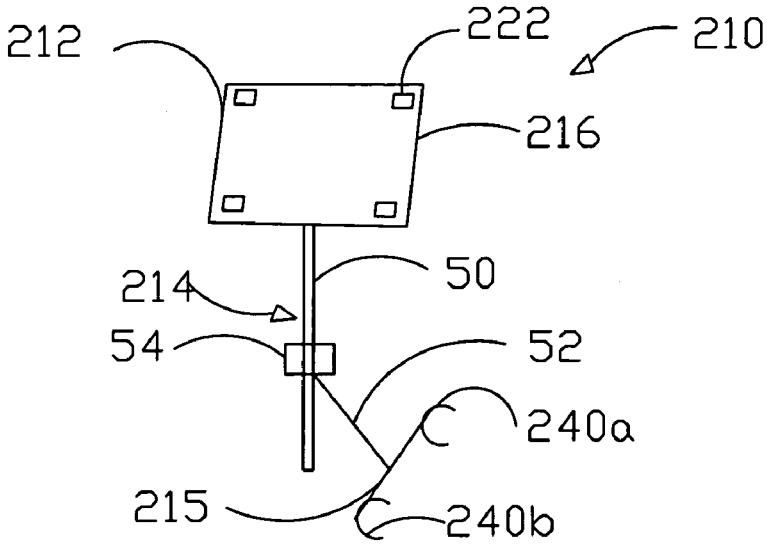
FIG. 2 is a schematic view of a book holder according to a second embodiment of the present invention.

The arm 14 comprises a first end 23 and second end 25. The clasp 15 is on the first end 23. The second end 25 is a spaced from the first end 23. The second end 25 is adjustably attached to the book platform 12. The arm 14 includes a telescoping arrangement 32 in which an upper support portion 34 of the support arm 14 slides within a lower support portion 36 and is held at a selected position by a locking member 55 (FIG. 2). The lower support portion 36 of the support arm 14 is attached to the clasp 15. The clasp 15 comprises one or more clips 40 for removeably attaching the book holder 10 to the mobile vehicle (not shown).

The clips 40 are adjustable in shape and size to fit the shape and size of the supporting frame member on the mobile vehicle (not shown). The clips 40 comprise a pair of resilient C-shaped clip arms 42 adjustably attached to the clip 40. The first clip arm 42*a* is spaced from the second clip arm 42*b* in order to tightly retain the supporting frame member of the mobile vehicle (not shown) therebetween. To secure the book holder 10, the user forces the clip arms 42*a* and 42*b* apart to allow the frame member to slip between the clip arms 42*a*, 42*b*. The clip arms 42*a*, 42*b* then snap resiliently together to hold the book holder 10 to the frame member (not shown) of the mobile vehicle (not shown).

Referring to FIG. 2, the book holder 210 comprises a book support platform 212, a generally planar panel 216, a support arm 214 and a dual clasp 215. The support arm 214 comprises a support member 50 extending from the middle section of the panel 216, an elongate arm 52 and an adjustable angle mount 54. The angle mount 54 connects the support member 50 to the elongate arm 52 to hold the panel 216 in spaced relation to the clasp 215. The angle mount 54 comprises locking member 55 to hold the panel 216 and clasp 215 in the user selected position. The angle mount 54 allows the panel 216 to be adjusted both axially and rotationally with respect to the clasp 215. The book support 212 may be pivotally mounted (FIG. 4) to the support member 50 to allow the panel 216 to be pivoted with respect to the support member 50.

Continuing to refer to FIG. 2, the dual clasp 215 comprises a clip bar 238 and a pair of clips 240 attached to the clip bar 238. The clips 240 are spaced from each other to provide a secure attachment to the mobile vehicle (not shown). As a result, the book holder 210 of FIG. 2 is adjustable for height and rotation and pivotal angle with respect to the clasp 215.

Figure 3:
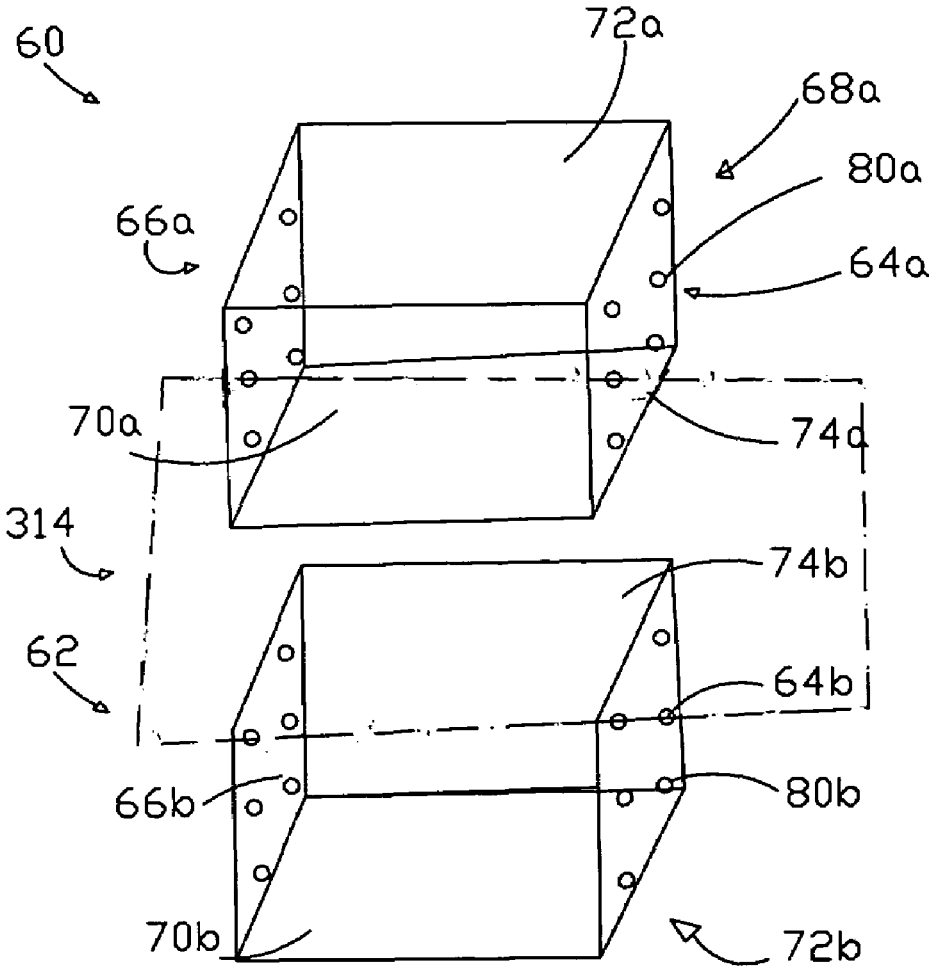
FIG. 3 is an exploded view of a book holder illustrating the square telescoping arm.

Referring now to FIG. 3 an alternative support arm 314 comprises concentrically mounted, square tube members 60, 62. The open box-shaped male member 60 is adapted to attach to a book support platform (12, FIG. 1) on one end and slidably insert into member 62 with the other end. The male member 60 is adapted for separable, concentric interconnection with the female member 62 to form a telescoping arrangement for axial adjustment of the spaced relational distance between the book support 312 and the female member 62. The male member 60 comprises a front portion 64*a*, a back portion 66*a*, a pair of side portions 68*a* and 70*a*, a lower portion 72*a*, and a top 74*a*. The side portions 68*a* and 70*a* of the male member 60 have holes 80*a* formed in a pattern therein. The top 74*a* is adapted to attach to the book support (12, FIG. 1). The female member 62 comprises a front portion 66*b*, a back portion 66*b*, a pair of side portions 68*b* and 70*b*, a lower portion 72*b*, and an open top 74*b*. The side portions 64*b* and 66*b* of the male member 62 have holes 80*b* formed therein for concentric alignment with the holes 80*a* in the male member 60. The lower portion 72*b* is adapted to attach to the clasp 15. The male member 60 fits slidably into the female member 62 such that at least one hole 80*a* in the side wall 64*a* of male member 60 is concentrically aligned with a hole 80*b* in the adjacent side wall 64*b* of the female member 62 at a predetermined position to axially space the clasp 15 from the book support (12, FIG. 1). The user then fixes the male member 60 to the female member 62 by connector means (not shown).

Figure 4:
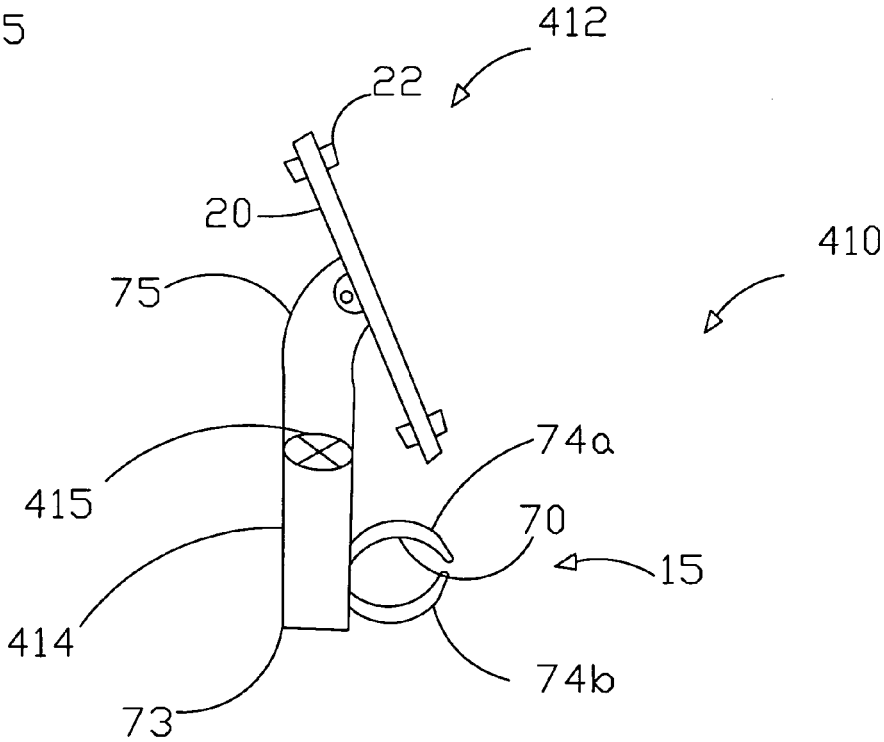
FIG. 4 is a side perspective view of the book holder of FIG. 1 illustrating an alternative clip arrangement.

FIG. 4 illustrates a book holder 410 comprising a book support 412 and a support arm 414. The support arm 414 comprises a clasp 15, a lower section 73 and an upper section 75. The clasp 15 comprises an adjustable clip 70 mounted on the lower section 73. The adjustable clip 70 is rotatable with respect to the arm 414 to removably attach the book holder 410 to a vertical or horizontal object (eg, a pole) (not shown) on the mobile vehicle. The arm connector 415 rotateably and slidably attaches the lower section 73 of the supporting arm 414 to the upper section 75. the upper section 75 has pivotal connector 420 (FIG. 4) on the book support 412. The clip 70 has adjustable clip arms 74*a*, 74*b* to allow different sizes of objects to be attached to the book holder 410. The position of the clip arms 74*a*, 74*b* along the clip body 78 can be selectively fixed by a screw 415.

Figure 5:
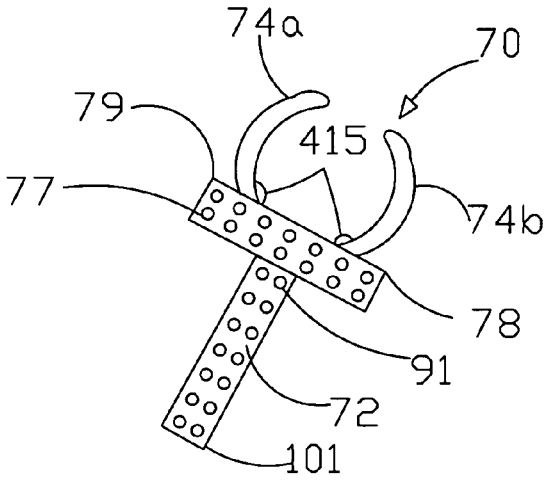
FIG. 5 is a perspective view an adjustable clip.

Referring to FIG. 5, the clasp 15 includes a clip body 101and a pair of clips arms 74*a*, 74*b* extending from the clip body 101. The clip 70 comprises a clip head 79 having a plurality of holes 77 fastener. The clip arms 74*a*, 74*b* are mounted on the clip head 79 in spaced relation to securely and removably attach the book holder 410 (FIG. 4) to the mobile vehicle (not shown). The body 101 of the clip 70 may have a plurality of holes 91 formed therein in spaced relation to each other for adjustable connection of the clip 70 to the arm 414 (FIG. 4). Each clip arm is attached to the clip body in one of several selectable positions along said clip body. Preferably, the clip 70 includes a clip body 101 on the arm 414, a clip head 79 on the clip body 101 and a plurality of clip arms 74*a*, 74*b* removably attached to the clip head 79. A screw 415 orother fastener is remvoably attached to the clip head 79 for selectively fixing the position of said clip arm along said clip body. The clip means may alternatively be a spring clip or include at least one resilient clip arm.

Figure 7:
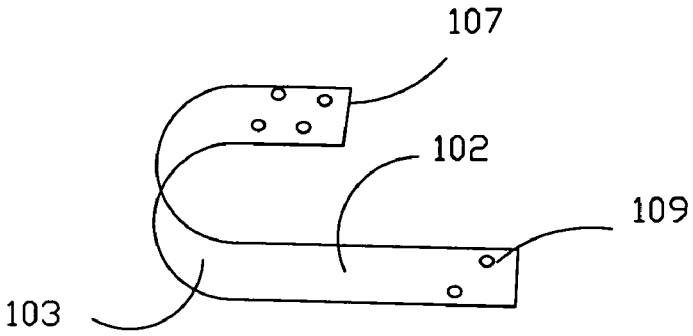
FIG. 7 is a perspective view of a clip arm.
Figure 6:
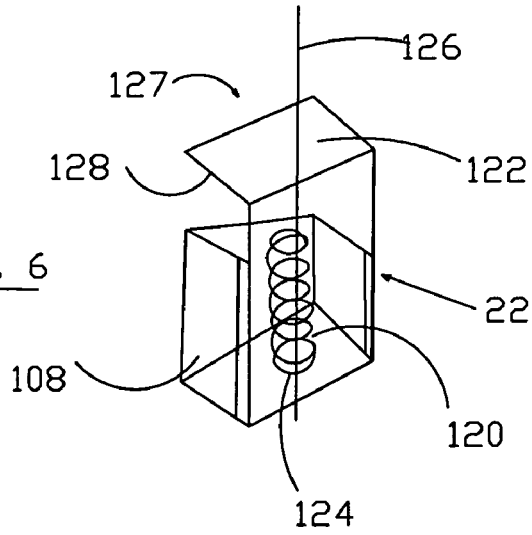
FIG. 6 is a perspective view of a book clamp.

Referring to FIG. 6 the head 79 is shown with two sets of clip arms 74*a*, 74*b* Each clip arm 74*a* and 74*b* is attached by fastener 81 which may be removable such as a screw. The arms 74 are thereby adjustably spaced from each other to adapt to resiliently clasping onto a mounting portion of the mobile vehicle (not shown).

referring to FIG. 7 a clip arm 74 is shown comprising a flex section 103, a base 102 and a tip 107. The base 102 has one or more holes 109 formed therein for aligning with a hole on the clip head 79 to accommodate attaching the clip arm 74*a* to the clip head 79 by screw, rivet or other mechanical fastener 81. The clip arms 74*a*, 74*b* are attached to the clip head 79 in a C relation (FIG. 6) to form adjustable clasp 15. The flex section 103 allows the tip 107 to deflect from its rest position to accommodate the portion of the vehicle to be attached to be disposed between the clip arms 74*a*, 74*b*. The resilient material of the lip arms 74*a*, 74*b* urges the tip 107 back to the rest position causing the clip arm 74*a*, 74*b* to bear against the vehicle to removably attach the book holder 10 to the vehicle (not shown). Tip 107 may also have holes 109 formed therein for alternate configurations on head 79 (FIG. 6) or alternate attachment methods.

Figure 8:
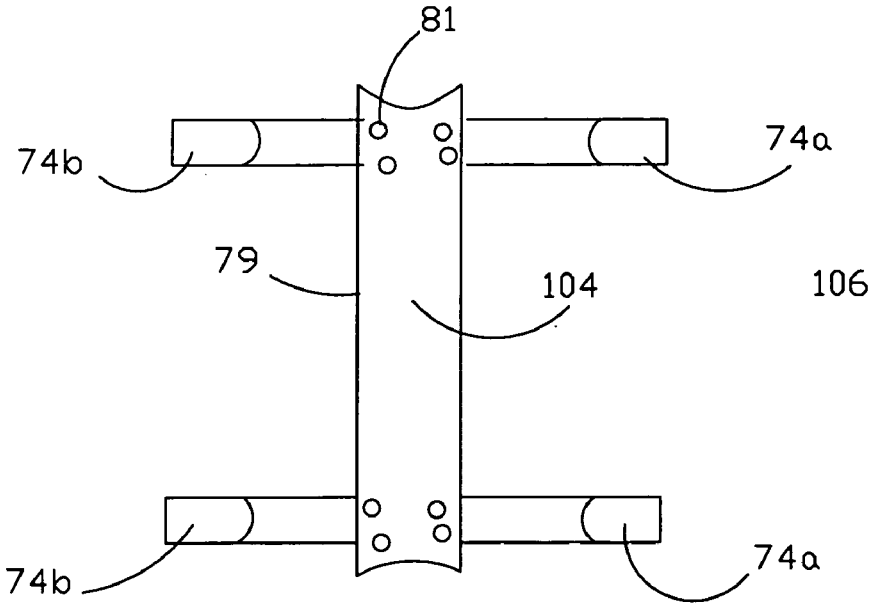
FIG. 8 is a elevation view of a plurality of clip arms from FIG. 7 on the clasp for releasable attachment of the book holder to a mobile vehicle.

Referring to FIG. 8, a book clamp 22 comprising a body 108, a spring 120 and a slidable grip 122. The slidable grip 122 is slidably mounted to the body 108. The spring 120 has a first end 124 on the body 108 and a second end 126 on the grip 122 to urge the grip in the clamped position 127. The book clamp 22 is mounted to the panel 16 having the grip 122 extending from the front surface 18 for engaging a book or other device to be retained on the book holder 10. The spring 129 and slidable attachment between the grip 122 and the clamp body 108 allow the grip to be moved into position to engage the book with the finger portion 128 of the grip 122. The spring 120 bears against the grip 122 to hold the book against the front surface 18 thereby securing the book (not shown) to the book holder 10.

In use, the book holder 10 is attached to the vehicle (not shown) by use of the clasp 15. The clasp 15 is rotationally adjusted on the support structure on the vehicle to begin the book holder 10 adjustment to a usable position. The telescoping mechanism in the arm 14 is used to axially adjust the spacing between the clasp 15 and the support platform 12. The rotational coupling between the first end of the arm 14 and the second end of the arm is used to rotate the support platform around the axis of the arm 14 to an operable position. Lastely, the pivotal connection 420 (FIG. 4) between the arm 14 and the support platform 12.

The book platform 12 may also be used to support such items as audio/video equipment, PDAs, or mobile phones, cameras, computers, musical instruments, toys, puzzles and games. The panel 16 may be provided with a set of mounting positions for receiving and/or mounting the above items (NOT SHOWN).

Although the invention has been described above in connection with particular embodiments and examples, it will be appreciated by those skilled in the art that the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

We claim:

1. A book holder for removable attachment, the book holder comprising:

a book support platform, the book support platform comprising a front surface, a rear surface and a plurality of clamps, the front surface adapted for supporting a book, the plurality of clamps disposed on the front surface to engage and retain the book to the book support platform, the rear surface separated from the front surface;

a clasp comprising a clip head, a clip body and a pair of resilient clip arms, the clip arms adjustably mounted on the clip head, the clip head attached to the clip body; and an arm comprising a first end and a second end and a telescoping arrangement, the clasp on the first end, the second end pivotally attached to the book support platform, the telescoping arrangement interconnecting the first end tob the second end, the clasp spaced from the book support platform wherein the book holder is removably attached and adjusted to a reading position by the telescoping arrangement axially adjusting the spaced relation between the book support platform and the clasp and the pivotal connection on the book support platform pivotally adjusting the front surface with respect to the arm.

* * * * *